US006736737B2

(12) United States Patent
Higuchi et al.

(10) Patent No.: US 6,736,737 B2
(45) Date of Patent: May 18, 2004

(54) MULTI-PIECE SOLID GOLF BALL

(75) Inventors: Hiroshi Higuchi, Chichibu (JP); Hirotaka Shimosaka, Chichibu (JP); Junji Umezawa, Chichibu (JP); Atsuki Kasashima, Chichibu (JP); Yasushi Ichikawa, Chichibu (JP); Rinya Takesue, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/022,395

(22) Filed: Dec. 20, 2001

(65) Prior Publication Data

US 2002/0119840 A1 Aug. 29, 2002

(30) Foreign Application Priority Data

Dec. 25, 2000 (JP) ..... 2000-392306

(51) Int. Cl.[7] ..... A63B 37/06
(52) U.S. Cl. ..... 473/376; 473/378
(58) Field of Search ..... 473/351, 377, 473/378, 376, 371

(56) References Cited

U.S. PATENT DOCUMENTS 4,919,434 A * 4/1990 Saito ..... 473/373
5,601,503 A * 2/1997 Yamagishi et al. ..... 473/384
5,688,595 A 11/1997 Yamagishi et al.
5,725,442 A 3/1998 Higuchi et al.
5,733,205 A 3/1998 Higuchi et al.
5,743,816 A 4/1998 Ohsumi et al.
5,783,293 A * 7/1998 Lammi ..... 428/212
5,830,086 A 11/1998 Hayashi et al.
6,015,356 A 1/2000 Sullivan et al.
6,056,650 A 5/2000 Yamagishi et al.
6,117,025 A * 9/2000 Sullivan ..... 473/373
6,117,026 A 9/2000 Hayashi et al.
6,152,834 A * 11/2000 Sullivan ..... 473/365

* cited by examiner

*Primary Examiner*—Raeann Gordon
(74) *Attorney, Agent, or Firm*—Sughrue Mion, PLLC

(57) ABSTRACT

In a multi-piece solid golf ball comprising a rubbery elastic solid core and a resin cover including at least an inner layer, an intermediate layer and an outer layer, the solid core undergoes a deflection of 1.6–6.0 mm under an applied load of 294 N (30 kgf), the cover inner layer has a Shore D hardness of 55–70, the cover intermediate layer has a Shore D hardness of 8–50 and a gage of 0.1–1.2 mm, and the cover outer layer has a Shore D hardness of 40–55. The ball prevents any undesired increase of spin upon driver shots without detracting from rebound, has good flight performance, and receives enough spin to facilitate control on short iron shots.

23 Claims, 1 Drawing Sheet

MULTI-PIECE SOLID GOLF BALL

This invention relates to a multi-piece solid golf ball comprising a rubbery elastic solid core and a resin cover of a plurality of layers enclosing the solid core, and more particularly, to such a multi-piece solid golf ball having a resin layer of at least three layers which is improved in flight distance performance and controllability.

BACKGROUND OF THE INVENTION

One of known solid golf balls has the structure in which a rubbery elastic solid core is enclosed with a cover of relatively hard ionomer resin characterized by good external damage prevention such as cut resistance and abrasion resistance.

The solid golf ball of this structure has improved flight distance performance, but gives a hard feel when hit, about which skilled golfers such as professional golfers complain. Attempts have been made to moderate the feel by constructing the resin cover from a plurality of layers including an inner layer and an outer layer, and endowing the inner layer with softness or increasing the gage of the inner layer.

However, merely making the cover inner layer softer or thicker gives rise to other problems that the ball receives more spin when hit with a small loft club such as a driver, the ball becomes less rebound and thus travels shorter, and the ball is likely to sky when hit with an iron club against the wind.

SUMMARY OF THE INVENTION

Therefore, an object of the invention is to provide a high-performance multi-piece solid golf ball comprising a rubbery elastic solid core and a resin cover of at least three layers, which ball prevents any undesired increase of spin upon driver shots without detracting from the rebound of the ball, has good flight performance, receives enough spin to facilitate control on short iron shots, and has durability and a pleasant feel when hit.

According to the invention, there is provided a multi-piece solid golf ball comprising a rubbery elastic solid core and a resin cover enclosing the solid core. The cover comprises at least three layers including an inner layer disposed adjacent to the solid core, an outer layer disposed radially outside the inner layer and provided on its outer surface with a multiplicity of dimples, and an intermediate layer between the inner layer and the outer layer. The solid core has a hardness corresponding to a deflection of at least 1.6 mm under an applied load of 294 N (30 kgf). The cover inner layer has a Shore D hardness of at least 55. The cover outer layer has a Shore D hardness of 40 to 55. The cover intermediate layer has a Shore D hardness X of 8 to 50 and a gage Y of up to 1.2 mm, wherein X and Y satisfy the relationship: $X/Y \geqq 35$. Desirably the Shore D hardness of the cover layers is in the order of inner layer≧outer layer≧intermediate layer.

In a preferred embodiment, the dimples are circular as viewed in plane, and the sum of dimple trajectory volumes each given as the volume of a dimple multiplied by the square root of a dimple diameter is in the range of 530 to 750.

Preferably, the cover inner layer is formed mainly of an ionomer resin or a resin blend of an ionomer resin with a polyolefin elastomer.

Preferably, the cover intermediate layer is formed mainly of a polyester elastomer, polyurethane elastomer, polyolefin elastomer, polyamide elastomer, ionomer resin or a mixture thereof and has a gage of 0.1 to 1.2 mm.

Preferably, the cover outer layer is formed mainly of a thermoplastic polyurethane elastomer, thermosetting polyurethane elastomer, polyester elastomer or a mixture thereof, and more preferably, it is formed mainly of a thermoplastic polyurethane elastomer obtained using an aromatic or aliphatic diisocyanate, or the reaction product of a thermoplastic polyurethane elastomer with an isocyanate compound.

Preferably, an adhesive layer intervenes between two adjacent layers of the cover.

In a multi-piece solid golf ball comprising a rubbery elastic solid core and a resin cover of at least three layers and having a multiplicity of dimples on the ball surface, the hardness and gage of the cover layers are properly combined whereby any undesired increase of spin upon full driver shots is restrained without detracting from the rebound of the ball. The sum of dimple trajectory volumes VT each given as the volume of a dimple multiplied by the square root of a dimple diameter is adjusted to an optimum range, whereby the ball follows a rather low trajectory which is further stretched near its fall. These factors cooperate to produce a high-performance multi-piece solid golf ball having advantages including minimized wind influence, improved flight performance, and an increased run upon shots with a driver, and good spin performance upon approach shots with a short iron.

DESCRIPTION OF THE PREFERRED EMBODIMENT

Figure 1:
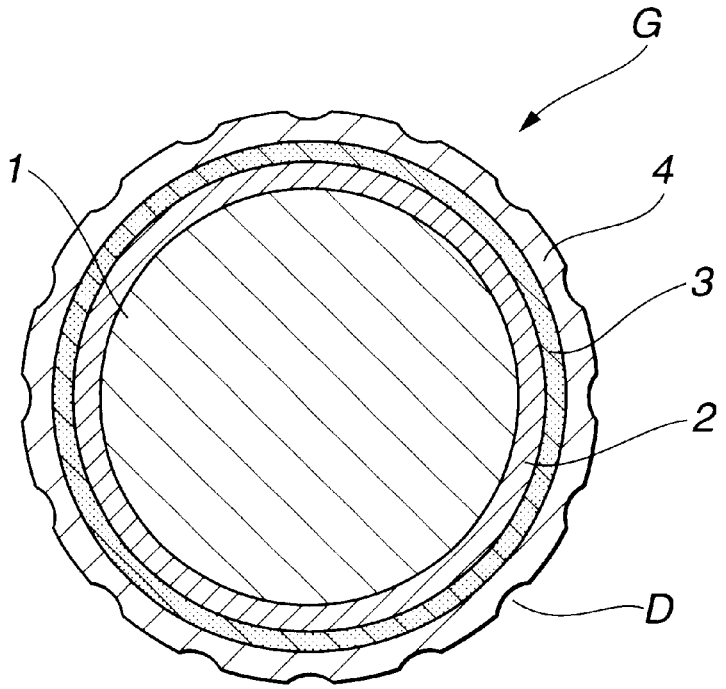
FIG. 1 is a cross-sectional view of a four-piece solid golf ball according to one embodiment of the invention.

The multi-piece solid golf ball of the invention is embodied in FIG. 1 as a four-piece solid golf ball G comprising a solid core 1, a cover inner layer 2 enclosing the core 1, a cover intermediate layer 3 enclosing the inner layer 2, and a cover outer layer 4 enclosing the intermediate layer 3, all in a concentric manner. It is noted that the cover is provided on the outer surface with a multiplicity of dimples D.

The solid core 1 is preferably formed of a rubber composition, which is preferably based on polybutadiene. The preferred polybutadiene is cis-1,4-polybutadiene having at least 40% of cis configuration. In the base rubber, polybutadiene is compounded with another rubber such as natural rubber, polyisoprene rubber or styrene-butadiene rubber if desired. Increasing the rubber content leads to golf balls with improved rebound.

In the rubber composition, there may be blended a crosslinking agent, for example, zinc and magnesium salts of unsaturated fatty acids such as zinc dimethacrylate and zinc diacrylate and esters such as trimethylpropane methacrylate. Zinc diacrylate is especially preferred. The crosslinking agent is preferably used in an amount of at least about 10 parts and up to about 50 parts by weight, and especially at least about 20 parts and up to about 45 parts by weight per 100 parts by weight of the base rubber.

A vulcanizing agent is generally blended in the rubber composition. It is recommended that the vulcanizing agent include a peroxide having a 1-minute half-life temperature of not higher than 155° C., the content of the peroxide being at least 30% by weight, and especially at least 40% by weight, of the overall vulcanizing agent. No particular upper limit is imposed on the content of peroxide, although this content is preferably not more than 70% by weight. Examples of suitable peroxides include commercially available products such as Perhexa 3M (manufactured by NOF Corp.). The amount of vulcanizing agent blended in the rubber composition is preferably set at about 0.6 to about 2 parts by weight per 100 parts by weight of the base rubber.

If necessary, other suitable ingredients may also be added to the rubber composition, including antioxidants and specific gravity-adjusting fillers such as zinc oxide and barium sulfate.

The solid core can be prepared from the above-described rubber composition. For example, after the components are kneaded in a conventional mixer such as a Banbury mixer or roll mill, the kneaded material is compression or injection molded in a core-forming mold where it is heated to a sufficient temperature for the crosslinking and vulcanizing agents to work, thereby effecting vulcanization or cure. In one example where dicumyl peroxide is used as the vulcanizing agent and zinc diacrylate used as the crosslinking agent, the material is heated at about 130 to about 170° C. for about 10 to 40 minutes, and especially at about 150 to about 160° C. for about 12 to 20 minutes.

As noted above, the solid core is prepared from the rubber composition by well-known molding and vulcanizing or curing techniques.

With respect to the hardness, the solid core should undergo a deflection under an applied load of 294 N (30 kgf) of at least 1.6 mm, preferably at least 1.7 mm, more preferably at least 1.8 mm, even more preferably at least 1.9 mm, most preferably at least 2.0 mm, and preferably up to 6.0 mm, more preferably up to 5.0 mm, even more preferably up to 4.0 mm, further preferably up to 3.5 mm, most preferably up to 3.0 mm. If the deflection of the core under an applied load of 294 N (30 kgf) is less than 1.6 mm, the feel of the ball when hit becomes undesirably hard. Too large a deflection may lead to losses of resilience and durability. The core has a hardness (JIS-C hardness) distribution in cross section which may be leveled or graded between the center and the outer surface or may locally vary (local hardness difference).

Preferably the solid core has a specific gravity of at least 1.0, more preferably at least 1.05, even more preferably at least 1.1 and up to 1.3, more preferably up to 1.25, even more preferably up to 1.2.

The solid core may have either a single-layer structure formed of one material or a multi-layer structure of two or more concentric layers of different materials.

In the preferred embodiment of the invention, the solid core 1 is enclosed with a resin cover consisting of three layers, inner layer 2, intermediate layer 3 and outer layer 4 as shown in FIG. 1.

The cover inner layer 2 that encloses the solid core 1 is preferably formed mainly of an ionomer resin or a resin blend of an ionomer resin with a polyolefin elastomer. Also useful are blends of an ionomer resin with a polyester elastomer, ionomer resins having an increased degree of neutralization, and ionomer resins having an increased acid content.

The blend of an ionomer resin with a polyolefin elastomer exhibits better properties (e.g., hitting feel and rebound) which cannot be arrived at using the components alone. Examples of the polyolefin elastomer include linear low-density polyethylene, low-density polyethylene, high-density polyethylene, polypropylene, rubber-reinforced olefin polymers, flexomers, plastomers, thermoplastic elastomers containing acid-modified ones (e.g., styrene base block copolymers and hydrogenated polybutadiene-ethylene-propylene rubber), dynamically vulcanized elastomers, ethylene acrylate, and ethylene vinyl acetate. Commercially available products include HPR from Dupont-Mitsui Polychemicals Co., Ltd. and Dynaron from JSR Corporation. The weight ratio of the ionomer resin to the polyolefin elastomer is preferably from 40:60 to 95:5, more preferably from 45:55 to 90:10, even more preferably from 48:52 to 88:12, and most preferably from 55:45 to 85:15. Too low a proportion of the polyolefin elastomer may often lead to a hard feel whereas too high a proportion thereof may lead to a decline of resilience.

The ionomer resins which can be used herein are of the neutralized type with such ions as Zn, Mg, Na and Li. An ionomer resin material is recommended comprising 5 to 100%, more preferably 10 to 80%, most preferably 15 to 70% by weight of a Zn or Mg ion-neutralized type ionomer resin which is relatively flexible and resilient. The ionomer resin may be blended with another polymer as long as it does not compromise the benefits of the invention.

The cover inner layer may also be formed of a blend of an ionomer resin with a polyester elastomer. The weight ratio of the ionomer resin to the polyester elastomer is preferably from 40:60 to 95:5, more preferably from 45:55 to 90:10, even more preferably from 48:52 to 88:12, and most preferably from 55:45 to 85:15. Too low a proportion of the polyester elastomer may lead to a hard feel whereas too high a proportion thereof may lead to a decline of resilience.

Also, the cover inner layer may be formed of a material comprising an ionomer resin, a fatty acid or derivative thereof having a molecular weight of at least 280, and a basic inorganic metal compound capable of neutralizing acid groups in the foregoing components, which are heated and mixed so that the degree of neutralization of acid groups on the ionomer resin is increased. Moreover, an ionomer resin having an increased acid content, such as Himilan AM7317 and AM7318 from Dupont-Mitsui Polychemicals Co., Ltd. may be used to form the cover inner layer.

It is preferred that the material of which the cover inner layer is made contain less than about 30%, especially 1 to 20% by weight of an inorganic filler such as zinc oxide, barium sulfate and titanium dioxide.

The cover inner layer should have a Shore D hardness of at least 55, preferably at least 56, more preferably at least 57, even more preferably at least 58, and most preferably at least 60 and preferably up to 70, more preferably up to 68, even more preferably up to 66, further preferably up to 64, and most preferably up to 62. The cover inner layer with too low a Shore D hardness provides the ball with less rebound whereas too high a Shore D hardness may give a hard feel.

The cover inner layer should preferably have a specific gravity of at least 0.8, more preferably at least 0.9, even more preferably at least 0.92 and up to 1.4, more preferably up to 1.16, even more preferably up to 1.1.

The cover inner layer preferably has a gage or radial thickness of at least 0.5 mm, more preferably at least 0.7 mm, even more preferably at least 0.9 mm, most preferably at least 1.1 mm and up to 3.0 mm, more preferably up to 2.5 mm, even more preferably up to 2.0 mm.

The cover intermediate layer 3 that encloses the cover inner layer 2 is preferably formed mainly of a polyester elastomer, polyurethane elastomer, polyolefine elastomer, polyamide elastomer, ionomer resin or a mixture of any. Such an intermediate layer-forming material may be selected from the materials commonly used as golf ball cover stocks.

The thermoplastic polyester elastomers are multi-block copolymers of the polyether ester family which are synthesized from terephthalic acid, 1,4-butanediol, polytetramethylene glycol (PTMG) and polypropylene glycol (PPG) and therefore, comprise hard segments of polybutylene terephthalate (PBT) and soft segments of polytetramethylene glycol (PTMG) and polypropylene glycol (PPG). They are commercially available as Hytrel 3078, 4047, G3548W, 4767 and 5577 from Dupont Toray Co., Ltd.

The thermoplastic polyurethane elastomer preferably has a molecular structure including soft segments of a high molecular weight polyol and hard segments constructed of a monomolecular chain extender and a diisocyanate. Such thermoplastic polyurethane elastomers are commercially available under the trade name of Pandex T7298 (−20° C.), T7295 (−26° C.), and T7890 (−30° C.) from Bayer DIC. Polymer Co., Ltd. in which the diisocyanate is aliphatic. It is noted that the temperature in parentheses indicates the tanδ peak temperature.

Examples of the polyolefin elastomer include linear low-density polyethylene, low-density polyethylene, high-density polyethylene, polypropylene, rubber-reinforced olefin polymers, flexomers, plastomers, thermoplastic elastomers containing acid-modified ones (e.g., styrene base block copolymers and hydrogenated polybutadiene-ethylene-propylene rubber), dynamically vulcanized elastomers, ethylene acrylate, and ethylene vinyl acetate. Commercially available products include HPR from Dupont Mitsui Polychemicals Co., Ltd. and Dynaron from JSR Corporation.

The polyamide elastomers are multi-block copolymers of the polyamide family which comprise hard segments of a nylon oligomer such as nylon 6, 11 or 12 and soft segments of polytetramethylene glycol (PTMG) or polypropylene glycol (PPG). They are commercially available as Pebax 2533, 3533 and 4033 from Elf Atochem.

Of these cover intermediate layer-forming materials, the polyester elastomers and polyolefin elastomers are especially preferred.

The cover intermediate layer should have a Shore D hardness of at least 8, preferably at least 10, more preferably at least 12, even more preferably at least 15, and most preferably at least 17 and up to 50, preferably up to 45, more preferably up to 35, even preferably up to 30, and most preferably up to 25. The cover intermediate layer with too low a Shore D hardness leads to a more spin and shorter carry on full shots whereas too high a Shore D hardness gives a too hard feel.

The cover intermediate layer has a gage or radial thickness of up to 1.2 mm, preferably up to 1.1 mm, more preferably up to 1.0 mm, even more preferably up to 0.9 mm, most preferably up to 0.8 mm and preferably at least 0.1 mm, more preferably at least 0.2 mm, even more preferably at least 0.3 mm, further preferably at least 0.4 mm, most preferably at least 0.5 mm. The gage of the intermediate layer is preferably minimum among the cover layers.

According to the invention, the cover intermediate layer has a Shore D hardness X and a gage Y, wherein A and B should satisfy the relationship: $X/Y \geqq 35$, preferably $X/Y \geqq 38$, more preferably $X/Y \geqq 40$, even more preferably $X/Y \geqq 41$, and most preferably $X/Y \geqq 42$. A X/Y value of less than 35 undesirably leads to a more spin and shorter carry on full shots.

The cover outer layer 4 that encloses the cover intermediate layer 3 is preferably formed mainly of a thermoplastic polyurethane elastomer, thermosetting polyurethane elastomer, polyester elastomer or a mixture of any. Also useful are polyamide elastomers, ionomer resins, blends of polyester elastomer and ionomer resin in a weight ratio between 100/0 and 60/40, compositions based on a thermoplastic polyurethane elastomer prepared using an aromatic or aliphatic isocyanate, and compositions based on the reaction product of the thermoplastic polyurethane elastomer with an isocyanate compound.

The thermoplastic polyurethane elastomer has a molecular structure including soft segments of a high molecular weight polyol and hard segments constructed of a monomolecular chain extender and a diisocyanate. The high molecular weight polyol compounds used herein include, though are not limited thereto, polyester polyols, polyether polyols, copolyester polyols, and polycarbonate polyols. The polyester polyols include polycaprolactone glycol, poly (ethylene-1,4-adipate) glycol, and poly(butylene-1,4-adipate) glycol. Typical of the copolyester polyols is poly (diethylene glycol adipate) glycol. One exemplary polycarbonate polyol is (hexanediol-1,6-carbonate) glycol. Polyoxytetramethylene glycol is typical of the polyether polyols. These polyols have a number average molecular weight of about 600 to 5,000, preferably about 1,000 to 3,000. The chain extender used herein may be any of commonly used polyhydric alcohols and amines. Examples include 1,4-butylene glycol, 1,2-ethylene glycol, 1,3-propylene glycol, 1,6-hexylene glycol, 1,3-butylene glycol, dicyclohexylmethylmethane diamine (hydrogenated MDA), and isophorone diamine (IPDA). The diisocyanates used herein are preferably aliphatic diisocyanates and aromatic diisocyanates. Exemplary aliphatic diisocyanates include hexamethylene diisocyanate (HDI), 2,2,4- or 2,4,4-trimethylhexamethylene diisocyanate (TMDI), and lysine diisocyanate (LDI). Exemplary aromatic diisocyanates include 2,4-toluene diisocyanate, 2,6-toluene diisocyanate, and 4,4-diphenylmethane diisocyanate. Of these, aliphatic diisocyanates are preferred from the standpoint of the cover's yellowing resistance, and HDI is most preferable because of compatibility in blending with other resins.

Of the thermoplastic polyurethane elastomers, those elastomers which on viscoelasticity measurement, exhibit a tanδ peak temperature of −15°C. or lower, more preferably −16° C. or lower, with the lower limit being −50° C. or higher, are preferred from the flexibility and resilience standpoint. Such thermoplastic polyurethane elastomers are commercially available under the trade name of Pandex T7298 (−20° C.), T7295 (−26° C.), and T7890 (−30° C.) from Bayer DIC. Polymer Co., Ltd. in which the diisocyanate is aliphatic. It is noted that the temperature in parentheses indicates the tanδ peak temperature.

As the cover outer layer material, the reaction product of the above-described thermoplastic polyurethane elastomer with an isocyanate compound may also be used because it can further improve the surface durability of the cover against iron shots.

The isocyanate compound used herein may be any of isocyanate compounds used in conventional polyurethanes. Exemplary aromatic isocyanate compounds include 2,4-toluene diisocyanate, 2,6-toluene diisocyanate or a mixture thereof, 4,4-diphenylmethane diisocyanate, m-phenylene diisocyanate, and 4,4'-biphenyl diisocyanate. Hydrogenated products of these aromatic isocyanate compounds, for example, dicyclohexylmethane diisocyanate are also useful. Also included are aliphatic isocyanates such as tetramethylene diisocyanate, hexamethylene diisocyanate (HDI) and octamethylene diisocyanate as well as alicyclic diisocyanates such as xylene diisocyanate. Other useful examples include blocked isocyanate compounds obtained by reacting a compound having at least two isocyanate groups at the end with a compound having active hydrogen, and uretidione forms resulting from isocyanate dimerization.

An appropriate amount of the isocyanate compound used is generally at least 0.1 part, preferably at least 0.2 part, more preferably at least 0.3 part by weight and up to 10 parts, preferably up to 5 parts, more preferably up to 3 parts by weight, per 100 parts by weight of the thermoplastic polyurethane elastomer. Too small an amount of the isocyanate compound may fail to induce sufficient crosslinking reaction, with little improvements in physical properties being observed. Too large an amount may give rise to several problems including substantial discoloration by aging, heat and ultraviolet radiation, the loss of thermoplasticity and a decline of resilience.

The thermosetting polyurethane of which the cover outer layer is made is obtained from a polyisocyanate such as 2,4-toluene diisocyanate (TDI), methylenebis(4-cyclohexyl isocyanate) (HMDI), 4,4'-diphenylmethane diisocyanate (MDI) or 3,3'-dimethyl-4,4'-biphenylene diisocyanate (TODI) and a polyol which will cure with a polyamine such as methylene dianiline (MDA), a trihydric glycol such as trimethylol propane or a tetrahydric glycol such as N,N,N',N'-tetrakis(2-hydroxypropyl)ethylene diamine.

Preferred polyether polyols are polytetramethylene ether glycol, poly(oxypropylene) glycol and polybutadiene glycol. Preferred polyester polyols are polyethylene adipate glycol, polyethylene propylene adipate glycol and polybutylene adipate glycol. Preferred polylactone polyols are diethylene glycol-initiated caprolactone, 1,4-butanediol-initiated caprolactone, trimethylol propane-initiated caprolactone and neopentyl glycol-initiated caprolactone. Of these polyols, preferred are polytetramethylene ether glycol, polyethylene adipate glycol, polybutylene adipate glycol and diethylene glycol-initiated caprolactone.

A suitable curing agent is selected from slow-reactive polyamines such as 3,5-dimethylthio-2,4-toluenediamine, 3,5-dimethylthio-2,6-toluenediamine, N,N'-dialkyldiaminodiphenylmethanes, trimethylene glycol di-p-aminobenzoate, polytetramethylene oxide di-p-aminobenzoate, dihydric glycols, and mixtures thereof. It is noted that 3,5-dimethylthio-2,4-toluenediamine and 3,5-dimethylthio-2,6-toluenediamine are isomers and commercially available under the trade name of ETHACURE® 300 from Ethyl Corporation; trimethylene glycol di-p-aminobenzoate and polytetramethylene oxide di-p-aminobenzoate are available under the trade name of POLACURE 740M and POLAMINES, respectively, from Polaroid; and N,N'-dialkyldiaminodiphenylmethane is available under the trade name of UNILINK® from UOP.

Preferred glycol is PTMEG or poly(tetramethylene ether) glycol.

Preferred dihydric glycols are 1,4-butanediol, 1,3-butanediol, 2,3-butanediol, 2,3-dimethyl-2,3-butanediol, dipropylene glycol and ethylene glycol. The dihydric glycols are essentially slow reactive.

As noted above, the thermosetting polyurethanes can be prepared from a number of commercially available aromatic, aliphatic and alicyclic diisocyanates and polyisocyanates.

The thermoplastic polyester elastomers of which the cover outer layer is made are multi-block copolymers of the polyether ester family which are synthesized from terephthalic acid, 1,4-butanediol, polytetramethylene glycol (PTMG) and polypropylene glycol (PPG) and therefore, comprise hard segments of polybutylene terephthalate (PBT) and soft segments of polytetramethylene glycol (PTMG) and polypropylene glycol (PPG). They are commercially available as Hytrel 3078, 4047, G3548W, 4767 and 5577 from Dupont Toray Co., Ltd.

The polyamide elastomers of which the cover outer layer is made are multi-block copolymers of the polyamide family which comprise hard segments of a nylon oligomer such as nylon 6, 11 or 12 and soft segments of polytetramethylene glycol (PTMG) or polypropylene glycol (PPG). They are commercially available as Pebax 2533, 3533 and 4033 from Elf Atochem.

Useful ionomer resins are those customarily used as the cover stock for solid golf balls. Such ionomer resins are commercially available, for example, under the trade name of Himilan 1855 from Dupont Mitsui Polychemicals Co., Ltd., and Surlyn 8120, 8320 and 6320 from E. I. Dupont. A mixture of two or more ionomer resins is also useful.

These cover materials may be used alone or in admixture. If necessary, well-known additives such as pigments, dispersants, antioxidants, UV absorbers, UV stabilizers and plasticizers may be blended in the cover material.

The cover outer layer should have a Shore D hardness of at least 40, preferably at least 42, more preferably at least 44, even more preferably at least 46, most preferably at least 48 and up to 55, preferably up to 54, more preferably up to 53, even more preferably up to 52. It is preferred that the cover outer layer be softer than the inner layer and harder than the intermediate layer, that is, the Shore D hardness of the cover layers be in the order of inner layer≧outer layer≧intermediate layer. The cover outer layer with too low a Shore D hardness has a propensity to receive too much spin, resulting in a reduced flight distance. Too high a Shore D hardness suppresses spin to an extremely low rate to decline controllability.

The cover outer layer should preferably have a specific gravity of at least 0.9, more preferably at least 0.95, even more preferably at least 1.0 and most preferably at least 1.05 and up to 1.3, more preferably up to 1.25, even more preferably up to 1.22 and most preferably up to 1.19. The cover outer layer preferably has a gage or radial thickness of at least 0.5 mm, more preferably at least 0.7 mm, even more preferably at least 0.9 mm and most preferably at least 1.1 mm and up to 2.5 mm, more preferably up to 2.3 mm, even more preferably up to 2.0 mm and most preferably up to 1.8 mm.

Any desired technique may be used to form the cover inner, intermediate and outer layers. Use may be made of conventional injection molding and compression molding techniques.

In one preferred embodiment, an adhesive layer intervenes between two adjacent layers of the cover, for example, between the inner layer and the intermediate layer and between the intermediate layer and the outer layer, for the purpose of improving the durability against strikes. As the adhesive, epoxy resin base adhesives, vinyl resin base adhesives, and rubber base adhesives may be used although urethane resin base adhesives and chlorinated polyolefin base adhesives are preferred.

Dispersion coating may be used to form the adhesive layer. The type of emulsion which is used in dispersion coating is not critical. The resin powder used in preparing the emulsion may be either thermoplastic resin powder or thermosetting resin powder. Exemplary resins are vinyl acetate resins, vinyl acetate copolymer resins, EVA (ethylene-vinyl acetate copolymer resins), acrylate (co) polymer resins, epoxy resins, thermosetting urethane resins, and thermoplastic urethane resins. Of these, epoxy resins, thermosetting urethane resins, thermoplastic urethane resins, and acrylate (co)polymer resins are preferred, with the thermoplastic urethane resins being most appropriate.

Preferably the adhesive layer has a gage of 0.1 to 30 $\mu$m, more preferably 0.2 to 25 $\mu$m, and even more preferably 0.3 to 20 $\mu$m.

A multiplicity of dimples are formed on the surface of the multi-piece solid golf ball constructed as above. In a preferred embodiment, the dimples are circular as viewed in plane, and the sum of dimple trajectory volumes VT each given as the volume of a dimple multiplied by the square root of a dimple diameter is in the range of 530 to 750. Note that the sum of dimple trajectory volumes VT is also referred to as total dimple trajectory volume TVT. The lower limit of TVT is at least 530, preferably at least 600, more preferably at least 610 whereas the upper limit of TVT is up to 750, preferably up to 700, more preferably up to 670.

Figure 2:
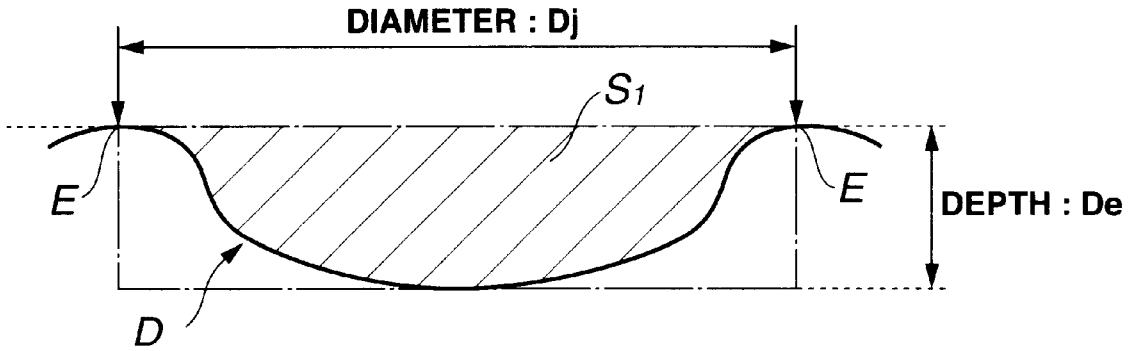
FIG. 2 is a cross-sectional view of a dimple.

Referring to FIG. 2, a dimple D is schematically shown in cross section at the center thereof (radial cross section with respect to the center of the ball). In the cross section of FIG. 2 wherein left and right crests are on a horizontal line, the crests are denoted dimple edges E, E and a dimple diameter $D_j$ is the distance between the dimple edges E and E. A dimple depth $D_e$ is the distance from the line segment between the dimple edges E and E to the dimple bottom. Then the volume V of the dimple is the volume corresponding to the shaded space delimited by the contour of the dimple and the line segment between the dimple edges E and E.

As noted above, the total dimple trajectory volume TVT is the sum of dimple trajectory volumes $VT=V\times D_i^{0.5}$. From the value of TVT, an approximate height of the trajectory of the ball when hit with a driver at a high head speed, typically of about 50 m/s can be estimated. In general, a smaller value of TVT provides a greater elevation angle and a larger value of TVT provides a smaller elevation angle. According to the invention, TVT is preferably set in the range of 530 to 750. Outside the range, a smaller value of TVT may lead to a higher trajectory and a shorter run, resulting in a decline of total distance. A larger value of TVT may lead to a lower trajectory and hence, a shorter carry, also resulting in a decline of total distance. Also outside the range of TVT, the ball may have noticeable variances of carry and lack performance stability.

As noted above, the dimples generally have a circular shape as viewed in plane. The diameter of dimples is preferably at least 1.8 mm, more preferably at least 2.4 mm, even more preferably at least 3.0 mm and preferably up to 4.6 mm, more preferably up to 4.4 mm, even more preferably up to 4.2 mm. The depth is preferably at least 0.08 mm, more preferably at least 0.1 mm, even more preferably at least 0.12 mm and preferably up to 0.22 mm, more preferably up to 0.2 mm, even more preferably up to 0.19 mm.

The total number of dimples is generally 360 to 540, preferably at least 380, more preferably at least 390 and preferably up to 450, more preferably up to 400. Preferably the dimples include dimples of two or more types, more preferably three or more types, even more preferably four or more types which differ in diameter, and preferably up to six types, more preferably up to five types which differ in diameter. Dimples of different types may differ in depth as well. Therefore, a combination of 4 to 10 types, especially 5 to 8 types of dimples having different values of VT is preferred.

For the arrangement of dimples, any well-known technique may be used, and no particular limit is imposed as long as the dimples are uniformly distributed. There may be employed any of the octahedral arrangement, icosahedral arrangement, and sphere division techniques of equally dividing a hemisphere into 2 to 6 regions wherein dimples are distributed in the divided regions. Fine adjustments or modifications may be made on these techniques. Preferably, the dimples occupy 69 to 82%, especially 72 to 77% of the ball surface.

The diameter and weight of the golf ball of the invention comply with the Rules of Golf. The ball is formed to a diameter of not less than 42.67 mm and preferably up to 44 mm, more preferably up to 43.5 mm, even more preferably up to 43 mm. The weight is not greater than 45.92 g and preferably at least 44.5 g, more preferably at least 44.8 g, even more preferably at least 45 g, and most preferably at least 45.1 g.

EXAMPLE

Examples and Comparative Examples are given below for illustrating the invention, but the invention is not limited to the following Examples.

Examples & Comparative Examples

According to a conventional golf ball manufacturing process, three- and four-piece solid golf balls as reported in Tables 7 and 8 were prepared by forming the solid cores shown in Tables 1 and 2 and successively forming thereon the cover inner, intermediate and outer layers as shown in Tables 3, 4 and 5 while forming dimples on the surface in a uniform arrangement as shown in Table 6.

TABLE 1

| Solid core composition (pbw) | ① | ② | ③ | ④ | ⑤ | ⑥ | ⑦ |
|---|---|---|---|---|---|---|---|
| Polybutadiene | 100 | 100 | 100 | 100 | 100 | 100 | 100 |
| Dicumyl peroxide | 1.2 | 1.2 | 1.2 | 1.2 | 1.2 | 1.2 | 1.2 |
| Barium sulfate | 25.5 | 15.5 | 15.5 | 17.0 | 20.0 | 17.0 | 19.5 |
| Zinc white | 5 | 5 | 5 | 5 | 5 | 5 | 5 |
| Antioxidant | 0.2 | 0.2 | 0.2 | 0.2 | 0.2 | 0.2 | 0.2 |
| Zinc salt of pentachlorothiophenol | 1 | 1 | 1 | 1 | 1 | 1 | 1 |
| Zinc diacrylate | 24 | 26 | 26 | 26 | 26 | 24 | 20 |

TABLE 2

| Solid core composition (pbw) | ⑧ | ⑨ | ⑩ | ⑪ | ⑫ | ⑬ |
|---|---|---|---|---|---|---|
| Polybutadiene | 100 | 100 | 100 | 100 | 100 | 100 |
| Dicumyl peroxide | 1.2 | 1.2 | 1.2 | 1.2 | 1.2 | 1.2 |
| Barium sulfate | 13.5 | 31.5 | 38.5 | 16.5 | 37.5 | 21.5 |
| Zinc white | 5 | 5 | 5 | 5 | 5 | 5 |
| Antioxidant | 0.2 | 0.2 | 0.2 | 0.2 | 0.2 | 0.2 |
| Zinc salt of pentachlorothiophenol | 1 | 1 | 1 | 1 | 1 | 1 |
| Zinc diacrylate | 22 | 23 | 20 | 37 | 31 | 37 |

Note:
Polybutadiene: JSR BR11 by JSR Corp.
Dicumyl peroxide: Percumyl D by NOF Corp.
Antioxidant: Nocrack NS6 by Ouchi Shinko Kagaku K.K.

TABLE 3

| Cover inner layer (pbw) | a | b | c | d | e | f | g |
|---|---|---|---|---|---|---|---|
| Nucrel AN4318 | | 15 | | | | | |
| Himilan 1706 | 50 | 42.5 | | | | | |
| Himilan 1605 | 50 | 42.5 | | | | | |
| Himilan 1557 | | | | | 50 | | |
| Himilan 1601 | | | | | 50 | | |
| Himilan AM7317 | | | | 50 | | | |
| Himilan AM7318 | | | | 50 | | | |
| Surlyn 8820 | | | | | | 100 | |
| Surlyn 9945 | | | 35 | | | | |
| Surlyn 8945 | | | 35 | | | | |
| Behenic acid | | 20 | | | | | |
| Calcium hydroxide | | 3 | | | | | |
| Dynaron 6100P | | | 30 | | | | |
| Titanium dioxide | 5.1 | 2 | 5.1 | 5.1 | 5.1 | 5.1 | |
| Polybutadiene | | | | | | | 100 |
| Dicumyl peroxide | | | | | | | 1.2 |
| Barium sulfate | | | | | | | 22.1 |
| Zinc white | | | | | | | 5 |
| Antioxidant | | | | | | | 0.2 |
| Zinc salt of pentachlorothiophenol | | | | | | | 1 |
| Zinc diacrylate | | | | | | | 23.5 |

Note that the amount of each additive is per 100 parts by weight of the resin components combined.

TABLE 4

| Cover intermediate layer (pbw) | A | B | C | D | E | F | G | H |
|---|---|---|---|---|---|---|---|---|
| Himilan 1706 | | | | | | | | 50 |
| Himilan 1605 | | | | | | | | 50 |
| Surlyn 6320 | | | | 100 | | | | |

TABLE 4-continued

| Cover intermediate layer (pbw) | A | B | C | D | E | F | G | H |
|---|---|---|---|---|---|---|---|---|
| Hytrel 4047 | | 100 | | | | | | |
| Hytrel 4701 | 100 | | | | | | | |
| Hytrel 3078 | | | | | 60 | 100 | | |
| HPR AR201 | | | | | 40 | | | |
| Pandex T-1188 | | | | | | | 100 | |
| Premalloy | | | 100 | | | | | |
| A1703C | | | | | | | | |
| Titanium dioxide | | | | 5.1 | | 5.1 | 2.7 | 5.1 |

Note that the amount of each additive is per 100 parts by weight of the resin components combined.

TABLE 5

| Cover outer layer (pbw) | ① | ② | ③ | ④ | ⑤ | ⑥ | ⑦ |
|---|---|---|---|---|---|---|---|
| Pandex TR3080 | | 30 | | | 50 | | |
| Pandex T7295 | | 70 | 100 | | 50 | | |
| Pandex 6098 | | | | 100 | | | |
| Himilan 1706 | | | | | | | 50 |
| Himilan 1605 | | | | | | 50 | 50 |
| Himilan 1557 | | | | | | 50 | |
| Surlyn 7930 | 37 | | | | | | |
| Surlyn AD8542 | 40 | | | | | | |
| Nucrel AN4318 | 23 | | | | | | |
| Titanium dioxide | 5.1 | 2.7 | 2.7 | 2.7 | 2.7 | 5.1 | 5.1 |
| Dicyclohexylmethane diisocyanate | | 1.5 | 1.5 | 1.5 | | | |

Note that the amount of each additive is per 100 parts by weight of the resin components combined.
Pandex: thermoplastic polyurethane elastomers by Bayer DIC Polymer Co., Ltd.
Nucrel: ethylene-methacrylic acid-acrylate copolymer and ethylene-methacrylic acid copolymer by Dupont Mitsui Polychemicals Co., Ltd.
Himilan: ionomer resins by Dupont Mitsui Polychemicals Co., Ltd.
Dynaron: hydrogenated polybutadiene by JSR Corp.
Premalloy: polymer alloy based on thermoplastic polyester elastomer by Mitsubishi Chemical Co., Ltd.
HPR: maleic anhydride-grafted ethylene-ethyl acrylate copolymer resin by Dupont Mitsui Polychemicals Co., Ltd.
Surlyn: ionomer resins by E. I. Dupont
Hytrel: thermoplastic polyester elastomers by Toray Dupont Co., Ltd.
Dicyclohexylmethane diisocyanate: by Bayer Sumitomo Urethane Industry Co., Ltd.

TABLE 6

| Set | | Dimples I | II | III | IV | V | VI |
|---|---|---|---|---|---|---|---|
| ① | Dimple number | 72 | 72 | 72 | 72 | 150 | 54 |
| | Diameter (mm) | 4.08 | 4.10 | 4.08 | 4.04 | 3.65 | 4.10 |
| | Depth (mm) | 0.161 | 0.163 | 0.183 | 0.177 | 0.15 | 0.21 |
| ② | Dimple number | 200 | 200 | 200 | 200 | 210 | 174 |
| | Diameter (mm) | 3.92 | 3.95 | 3.98 | 3.94 | 3.50 | 3.85 |
| | Depth (mm) | 0.152 | 0.154 | 0.174 | 0.165 | 0.15 | 0.21 |
| ③ | Dimple number | 120 | 120 | 120 | 120 | — | 132 |

TABLE 6-continued

| Set | | Dimples I | II | III | IV | V | VI |
|---|---|---|---|---|---|---|---|
| | Diameter (mm) | 3.14 | 3.14 | 3.18 | 3.10 | — | 3.40 |
| | Depth (mm) | 0.128 | 0.128 | 0.133 | 0.138 | — | 0.21 |
| Total dimple number | | 392 | 392 | 392 | 392 | 360 | 360 |
| TVT | | 598.0 | 615.4 | 694.3 | 540.3 | 513.4 | 854.5 |

A flight test was carried out on each of the thus prepared golf balls by the following method. Also spin, feel, scraping resistance, and consecutive durability were evaluated by the following methods. The results are shown in Tables 7 and 8.

Flight Test

Using a swing robot of Miyamae K.K., twenty balls of each Example were hit with a driver (#W1) at a head speed (HS) of 50 m/s. Carry and total distance were measured, and trajectory rated.

Club used

Head: manufactured by Bridgestone Sports Co., Ltd., J's METAL, loft angle 7.50°, lie angle 57°, SUS630 stainless steel, lost wax process Shaft: Harmotech Pro, HM-70, LK (low kick point), hardness X Spin The ball was hit with a driver (#W1), No. 5 iron (#I5) at a head speed (HS) of 38 m/s and a sand wedge (#SW) at a head speed (HS) of 20 m/s. The behavior of the ball immediately after impact was captured by photography, and the spin rate was calculated from image analysis.

Feel

Three professional golfers actually hit the ball with a driver (#W1) and putter (#PT) and rated according to the following criterion.

◎: soft

○: rather soft

Δ: rather hard

X: hard

Scraping Resistance

Using the swing robot, the ball was hit at two arbitrary positions with a sand wedge (#SW) at a head speed of 38 m/s. The ball was visually observed and rated according to the following criterion.

◎: excellent

○: good

Δ: fair

X: hard

Consecutive Durability

Using a flywheel hitting machine, the ball was repetitively struck at a head speed of 38 m/s until the ball was broken. The ball was rated in terms of the number of strikes at rupture according to the following criterion.

◎: excellent

○: good

Δ: fair

X: poor

TABLE 7

| | | Example | | | | | |
|---|---|---|---|---|---|---|---|
| | | 1 | 2 | 3 | 4 | 5 | 6 |
| Core | Type | 1 | 2 | 3 | 4 | 5 | 6 |
| | Outer diameter (mm) | 34.4 | 34.4 | 34.4 | 35.4 | 34.4 | 35.4 |
| | Deflection under 30 kg load (mm) | 2.3 | 2.0 | 2.0 | 2.0 | 2.0 | 2.3 |
| | Specific gravity | 1.21 | 1.16 | 1.16 | 1.17 | 1.19 | 1.16 |
| Cover inner layer | Type | a | b | c | d | a | e |
| | Shore D hardness | 62 | 60 | 56 | 65 | 62 | 60 |
| | Specific gravity | 0.98 | 0.96 | 0.96 | 0.98 | 0.98 | 0.98 |
| | Gage (mm) | 1.6 | 1.8 | 1.8 | 1.6 | 1.6 | 1.7 |
| Cover intermediate layer | Type | A | B | B | C | D | E |
| | Specific gravity | 1.15 | 1.12 | 1.12 | 0.98 | 0.98 | 1.03 |
| | Shore D hardness X | 47 | 40 | 40 | 25 | 45 | 23 |
| | Gage Y (mm) | 1.1 | 0.9 | 0.9 | 0.6 | 1.1 | 0.5 |
| | X/Y | 43 | 44 | 44 | 42 | 41 | 46 |
| Adhesive layer | | absent | present | present | present | present | present |
| Cover outer layer | Type | 1 | 2 | 3 | 4 | 5 | 4 |
| | Specific gravity | 0.98 | 1.18 | 1.18 | 1.18 | 1.18 | 1.18 |
| | Gage (mm) | 1.5 | 1.5 | 1.5 | 1.5 | 1.5 | 1.5 |
| | Shore D hardness | 50 | 47 | 50 | 53 | 45 | 53 |
| Ball | Weight (g) | 45.3 | 45.4 | 45.4 | 45.4 | 45.4 | 45.4 |
| | Outer diameter (mm) | 42.7 | 42.7 | 42.7 | 42.7 | 42.7 | 42.7 |
| | Dimple set | I | II | II | III | I | III |
| #W1/HS50 | Carry (m) | 240.0 | 240.5 | 239.5 | 238.5 | 238.5 | 238.0 |
| | Total (m) | 251.5 | 251.5 | 250.0 | 248.0 | 250.5 | 247.5 |
| | Spin (rpm) | 3220 | 3300 | 3330 | 3550 | 3240 | 3620 |
| | Feel | ○ | ○ | ○ | ◎ | ○ | ◎ |
| | Trajectory | somewhat high, but stretching trajectory | low, stretching trajectory | low, stretching trajectory | low, slightly rising, stretching trajectory | somewhat high, but stretching trajectory | low, slightly rising, stretching trajectory |
| #I5/HS38 | Spin (rpm) | 6490 | 6700 | 6750 | 7250 | 7310 | 7120 |
| #SW/HS20 | Spin (rpm) | 6280 | 6370 | 6310 | 6280 | 6400 | 6290 |
| PT | Feel | ○ | ◎ | ◎ | ◎ | ◎ | ◎ |
| Scraping resistance | | Δ | ○ | ○ | ◎ | ◎ | ◎ |
| Consecutive durability | | ◎ | ◎ | ◎ | ○ | ◎ | ◎ |

TABLE 8

| | | Example | | Comparative Example | | | | |
|---|---|---|---|---|---|---|---|---|
| | | 7 | 8 | 1 | 2 | 3 | 4 | 5 |
| Core | Type | 7 | 8 | 9 | 10 | 11 | 12 | 13 |
| | Outer diameter (mm) | 34.4 | 35.4 | 33.1 | 32.6 | 20.0 | 33.0 | 36.0 |
| | Deflection under 30 kg load (mm) | 3.1 | 2.3 | 2.6 | 3.1 | 1.2 | 1.6 | 1.2 |
| | Specific gravity | 1.17 | 1.14 | 1.24 | 1.27 | 1.19 | 1.29 | 1.22 |
| Cover inner layer | Type | c | b | f | d | g | d | e |
| | Shore D hardness | 56 | 60 | 65 | 65 | 43 | 65 | 60 |
| | Specific gravity | 0.96 | 0.96 | 0.98 | 0.98 | 1.19 | 0.98 | 0.98 |
| | Gage (mm) | 2.0 | 1.5 | 1.5 | 1.5 | 7.7 | 2.3 | 1.8 |
| Cover intermediate layer | Type | F | G | B | F | B | H | |
| | Specific gravity | 1.12 | 1.21 | 1.12 | 1.08 | 1.12 | 0.98 | |
| | Shore D hardness X | 30 | 30 | 40 | 30 | 40 | 62 | |
| | Gage Y (mm) | 0.7 | 0.7 | 1.5 | 1.5 | 1.7 | 1.1 | |
| | X/Y | 43 | 43 | 27 | 20 | 24 | 56 | |
| Adhesive layer | | present | present | absent | absent | absent | absent | absent |
| Cover outer layer | Type | 3 | 3 | 6 | 7 | 7 | 1 | 1 |
| | Specific gravity | 1.18 | 1.18 | 0.98 | 0.98 | 0.98 | 0.98 | 0.98 |
| | Gage (mm) | 1.5 | 1.5 | 1.8 | 2.1 | 2.0 | 1.5 | 1.6 |
| | Shore D hardness | 50 | 50 | 58 | 62 | 62 | 50 | 50 |
| Ball | Weight (g) | 45.4 | 45.4 | 45.3 | 45.3 | 45.3 | 45.3 | 45.3 |
| | Outer diameter (mm) | 42.7 | 42.7 | 42.7 | 42.7 | 42.7 | 42.7 | 42.7 |
| | Dimple set | II | III | IV | V | IV | V | VI |
| #W1/HS50 | Carry (m) | 239.0 | 237.5 | 235.5 | 238.0 | 234.0 | 238.5 | 234.0 |
| | Total (m) | 249.0 | 247.5 | 243.0 | 248.5 | 241.0 | 250.0 | 247.0 |
| | Spin (rpm) | 3320 | 3560 | 3860 | 3560 | 3890 | 3220 | 3280 |
| | Feel | ◎ | ◎ | ○ | ○ | × | × | × |
| | Trajectory | low, stretching trajectory | low, slightly rising stretching trajectory | somewhat high, skying trajectory | too high, stalling trajectory | somewhat high, skying trajectory | somewhat high, but stretching trajectory | too low, dropping trajectory |

TABLE 8-continued

| | | Example | | Comparative Example | | | | |
|---|---|---|---|---|---|---|---|---|
| | | 7 | 8 | 1 | 2 | 3 | 4 | 5 |
| #I5/HS38 | Spin (rpm) | 6810 | 7180 | 5890 | 4840 | 5570 | 6200 | 6320 |
| #SW/HS20 | Spin (rpm) | 6280 | 6300 | 5870 | 4420 | 4450 | 6170 | 6210 |
| PT | Feel | ◎ | ◎ | Δ | × | × | × | Δ |
| Scraping resistance | | ○ | ○ | ○ | ◎ | ◎ | × | × |
| Consecutive durability | | ○ | ◎ | Δ | × | ○ | ◎ | ◎ |

There has been described a multi-piece solid golf ball comprising a rubbery elastic solid core and a resin cover of at least three layers, which ball prevents any undesired increase of spin upon driver shots without detracting from the rebound of the ball, has good flight performance, receives enough spin to facilitate control on short iron shots, and has durability and a pleasant feel when hit.

Japanese Patent Application No. 2000-392306 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A multi-piece solid golf ball comprising a rubbery elastic solid core and a resin cover enclosing the solid core, said cover comprising at least three layers including an inner layer disposed adjacent to the solid core, an outer layer disposed radially outside the inner layer and provided on its outer surface with a multiplicity of dimples, and an intermediate layer between the inner layer and the outer layer, wherein said solid core has a hardness corresponding to a deflection of at least 1.6 mm under an applied load of 294 N (30 kgf), said cover inner layer has a Shore D hardness of at least 55, said cover outer layer has a Shore D hardness of 40 to 55, said cover intermediate layer has a Shore D hardness X of 8 to 50 and a gage Y of 0.1 mm to 0.9 mm, wherein X and Y satisfy the relationship: $X/Y \geqq 35$, and said Shore D hardness of the cover layers is in the order of inner layer> outer layer>intermediate layer, wherein the dimples are composed of a combination of 4 to 10 types of dimples having different values of a dimple trajectory volume VT, which is given as the volume of a dimple multiplied by the square root of a dimple diameter, and the sum of dimple trajectory volumes TVT is in the range of 530 to 750.

2. The golf ball of claim 1 wherein said cover outer layer is formed mainly of a thermoplastic polyurethane elastomer, thermosetting polyurethane elastomer, polyester elastomer or a mixture thereof.

3. The golf ball of claim 1 wherein the sum of dimple trajectory volumes TVT is in the range 598 to 750.

4. A multi-piece solid golf ball comprising a rubbery elastic solid core and a resin cover enclosing the solid core, said cover comprising at least three layers including an inner layer disposed adjacent to the solid core, an outer layer disposed radially outside the inner layer and provided on its outer surface with a multiplicity of dimples, and an intermediate layer between the inner layer and the outer layer, wherein said solid core has a hardness corresponding to a deflection of at least 1.6 mm under an applied load of 294 N (30 kgf), said cover inner layer has a Shore D hardness of at least 55, said cover outer layer has a Shore D hardness of 40 to 55, said cover intermediate layer has a Shore D hardness X of 8 to 50 and a gage Y of 0.1 mm to 0.9 mm, wherein X and Y satisfy the relationship: $X/Y \geqq 38$, and said Shore D hardness of the cover layers is in the order of inner layer> outer layer>intermediate layer, wherein said cover outer layer is formed mainly of a thermoplastic polyurethane elastomer, thermosetting polyurethane elastomer, polyester elastomer or a mixture thereof, and wherein said cover outer layer is formed mainly of a thermoplastic polyurethane elastomer obtained using an aromatic or aliphatic diisocyanate.

5. The golf ball of claim 4 wherein the dimples are circular as viewed in plane, and the sum of dimple trajectory volumes each given as the volume of a dimple multiplied by the square root of a dimple diameter is in the range of 530 to 750.

6. The golf ball of claim 4 wherein said cover inner layer is formed mainly of an ionomer resin or a resin blend of an ionomer resin with a polyolefin elastomer.

7. The golf ball of claim 4 wherein said cover intermediate layer is formed mainly of a polyester elastomer, polyurethane elastomer, polyolefin elastomer, polyamide elastomer, ionomer resin or a mixture thereof.

8. The golf ball of claim 4 wherein an adhesive layer intervenes between two adjacent layers of the cover.

9. The golf ball of claim 4 wherein the solid core has a hardness corresponding to a deflection of 1.7 mm to 5.0 mm under an applied load of 294 N (30 kgf).

10. The golf ball of claim 4 wherein the solid core has a specific gravity of 1.0 to 1.3.

11. The golf ball of claim 4 wherein the cover inner layer comprises from 1% to 30% by weight of an inorganic filler such as zinc oxide, barium sulfate and titanium dioxide.

12. The golf ball of claim 4 wherein the cover inner layer has a specific gravity of 0.8 to 1.16.

13. The golf ball of claim 4 wherein the cover inner layer has a gage of 0.5 mm to 3.0 mm.

14. The golf ball of claim 4 wherein the cover outer layer has a specific gravity of 0.95 to 1.3.

15. The golf ball of claim 4 wherein the cover outer layer has a gage of 0.5 mm to 2.5 mm.

16. The golf ball of claim 4 wherein the relationship of X/Y is at least 40.

17. A multi-piece solid golf ball comprising a rubbery elastic solid core and a resin cover enclosing the solid core, said cover comprising at least three layers including an inner layer disposed adjacent to the solid core, an outer layer disposed radially outside the inner layer and provided on its outer surface with a multiplicity of dimples, and an intermediate layer between the inner layer and the outer layer, wherein said solid core has a hardness corresponding to a deflection of at least 1.6 mm under an applied load of 294 N (30 kgf), said cover inner layer has a Shore D hardness of at least 55, said cover outer layer has a Shore D hardness of 40 to 55, said cover intermediate layer has a Shore D hardness X of 8 to 50 and a gage Y of 0.1 mm to 0.9 mm, wherein X and Y satisfy the relationship: $X/Y \geqq 38$, and said Shore D hardness of the cover layers is in the order of inner layer> outer layer>intermediate layer, wherein said cover outer layer is formed mainly of a thermoplastic polyurethane elastomer, thermosetting polyurethane elastomer, polyester elastomer or a mixture thereof, and wherein said cover outer layer is formed mainly of the reaction product of a thermoplastic polyurethane elastomer with an isocyanate compound.

18. A multi-piece solid golf ball comprising a rubbery elastic solid core and a resin cover enclosing the solid core, said cover comprising at least three layers including an inner layer disposed adjacent to the solid core, an outer layer disposed radially outside the inner layer and provided on its outer surface with a multiplicity of dimples, and an intermediate layer between the inner layer and the outer layer, wherein said solid core has a hardness corresponding to a deflection of at least 1.6 mm under an applied load of 294 N (30 kgf), said cover inner layer is formed mainly of a resin blend of an ionomer resin with a polyolefin elastomer and has a Shore D hardness of at least 55, said cover outer layer has a Shore D hardness of 40 to 55, and said cover intermediate layer has a Shore D hardness X of 8 to 50 and a gage Y of up to 1.2 mm, wherein X and Y satisfy the relationship: $X/Y \geqq 35$, wherein a weight ratio of the ionomer resin to polyolefin elastomer is from 40:60 to 95:5.

19. The golf ball of claim 18 wherein said cover intermediate layer has a gage of 0.1 mm to 0.9 mm.

20. The golf ball of claim 18 wherein the Shore D hardness of the cover layers is in the order of inner layer>outer layer>intermediate layer.

21. The golf ball of claim 18 wherein said cover intermediate layer has a Shore D hardness of X and a gage Y of 0.1 mm to 0.9 mm, wherein X and Y satisfy the relationship $X/Y \geqq 38$.

22. The golf ball of claim 18 wherein the dimples are circular as viewed in plane, and the sum of dimple trajectory volumes each given as the volume of a dimple multiplied by the square root of a dimple diameter is in the range of 598 to 750.

23. A multi-piece solid golf ball comprising a rubbery elastic solid core and a resin cover enclosing the solid core, said cover comprising at least three layers including an inner layer disposed adjacent to the solid core, an outer layer disposed radially outside the inner layer and provided on its outer surface with a multiplicity of dimples, and an intermediate layer between the inner layer and the outer layer, wherein said solid core has a hardness corresponding to a deflection of at least 1.6 mm under an applied load of 294 N (30 kgf), said cover inner layer is formed mainly of a resin blend of an ionomer resin with a polyolefin elastomer and has a Shore D hardness of at least 55, said cover outer layer is formed mainly of the reaction product of a thermoplastic polyurethane elastomer with an isocyanate compound and has a Shore D hardness of 40 to 55, and said cover intermediate layer has a Shore D hardness X of 8 to 50 and a gage Y of up to 1.2 mm, wherein X and Y satisfy the relationship: $X/Y \geqq 35$.

* * * * *